US005111874A

United States Patent [19]

Kosson

[11] Patent Number: 5,111,874

[45] Date of Patent: May 12, 1992

[54] HEAT PIPE SWITCH

[75] Inventor: Robert L. Kosson, Mass, N.Y.

[73] Assignee: Grumman Aerospace Corporation, Bethpage, N.Y.

[21] Appl. No.: 666,013

[22] Filed: Mar. 7, 1991

[51] Int. Cl.[5] ..... F28D 15/02; F28F 27/00

[52] U.S. Cl. ..... 165/32; 165/41; 165/104.26

[58] Field of Search ..... 165/32, 104.26, 41

[56] References Cited

U.S. PATENT DOCUMENTS 4,007,777 2/1977 Sun et al. ..... 165/32

*Primary Examiner*—Albert W. Davis, Jr.

*Attorney, Agent, or Firm*—Pollock, VandeSande & Priddy

[57] ABSTRACT

A thermal pipe switch includes a single vapor channel communicating with two parallel formed liquid channels. Each of the liquid channels is connected to a respective liquid channel in a dual heat sink assembly which thermally contacts a cryocooler. If a first cryocooler becomes operative, liquid in the heat pipe thermal switch will fill a liquid channel communicating with the heat sink liquid channel which thermally contacts an operative cryocooler. The other heat pipe thermal switch liquid channel is filled with vapor so as to thermally decouple its respectively connected thermal cooler from the system.

8 Claims, 1 Drawing Sheet

HEAT PIPE SWITCH

FIELD OF THE INVENTION

The present invention relates to heat pipe technology, and more particularly to a thermal switch operating as a heat pipe.

BACKGROUND OF THE INVENTION

In a number of space surveillance systems, detectors are mounted on a focal plane. The detectors may be of the type which require cooling. The prior art includes the mounting of numerous detectors in an array on a focal plane; and in order to cool the array, heat pipes are mounted to the rear of the array focal plane.

Certain types of detectors require operation at extremely low temperatures. At these temperatures active cryocoolers are strong candidates because of the limited heat rejection per unit area available with passive cryoradiators and the subsequent large required radiator areas. However, all current active cryocoolers for space surveillance systems have less projected operating life than desired. Providing two cryocoolers, with only one operating at a given time, would theoretically double the operating life of a surveillance system. The non-operating cryocooler must be thermally decoupled from a cryogenic loop to prevent excessive heat leakage. Thermal switches based on heat pipe technology have been proposed to permit switching between coolers while preventing heat transfer from a warmer inactive cooler. However, known switches offer inadequate performance.

BRIEF DESCRIPTION OF THE PRESENT INVENTION

The present invention is directed to a heat pipe thermal switch which offers the reliable performance required for individually switching in cryocoolers to a heat pipe array. The present invention provides a thermal switch based on heat pipe technology that connects two cryocoolers to a focal plane array so that either cryocooler is thermally coupled to the array when operating and is thermally isolated when not operating. The present invention has application in many multimode thermal systems using either stored cryogens, passive radiators, or active coolers in any of a variety of hybrid combinations.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
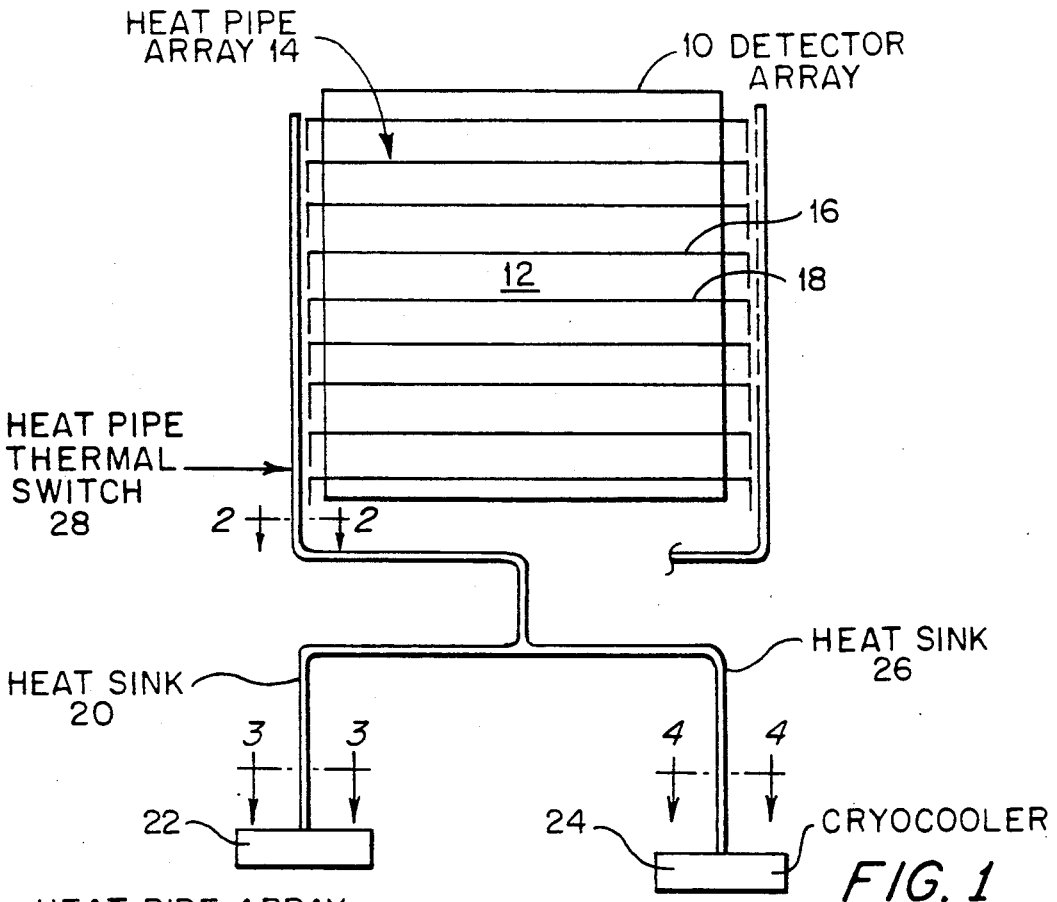
FIG. 1 is a schematic illustration of the present invention when employed between a heat pipe array and two individually operable cryocoolers.

The present invention is schematically illustrated in FIG. 1 and is intended to cool a detector array 10 which must operate at very low temperatures during space surveillance. The particular detectors are prior art and do not, in and of themselves, constitute the present invention.

As illustrated in FIG. 1, the detector array 10 is cooled by a heat pipe array 14 which contacts a focal plane surface 12. The opposite (non-illustrated) surface would physically mount the elements of the detector array 10. The individual heat pipes of array 14 are located in parallel spaced relationship such as heat pipes 16, 18. The purpose of the present invention is to create a thermal switch for connecting the heat pipe array 14 to either cryocooler 22 or 24 through their respective heat sinks 20 and 26. More specifically, a heat pipe thermal switch 28 provides a common cryogenic path between the heat pipe array 14 and heat sinks 20 and 26. This common path eliminates the need for individual paths that would pose a space and weight problem for the system which is intended for remote space surveillance applications. The figure illustrates an optional second symmetrical thermal switch 28 (shortened) which would be identical and connected for redundancy.

Figure 3:
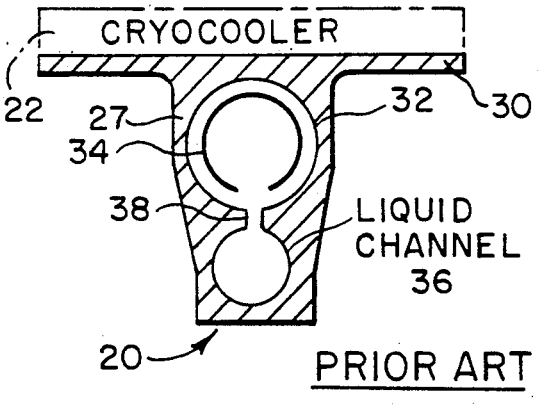
PRIOR ART FIG. 3
FIG. 3 is a cross-sectional view of a heat sink connected between the switch of FIG. 1 and a cryocooler.

FIG. 3 illustrates a heat sink 20 which has the form of a prior art heat pipe which dumps heat collected from the heat pipe array 14. This structure is more fully described in U.S. Pat. No. 4,470,451, issued on Sep. 11, 1984, to the present assignee. The body of heat sink 20 includes a main body 27 extending perpendicularly from a flange 30. Within the body exists a first channel 32 having circular cross section and which serves as a vapor channel. The wall of the vapor channel contains a multiplicity of circumferential grooves 34 which are schematically illustrated. These grooves extend along the length of the vapor channel over which heat rejection takes place. Cryocooler 22 is mounted to flange 30 and heat transfer occurs between the metallic body 27 of the heat sink 20 and the cryocooler 22 when the cryocooler is operating. The body 27 of the heat sink 20 further has a second channel existing in parallel spaced relationship to the first channel and having a somewhat smaller diameter. The second channel is a liquid channel 36 and is interconnected with the vapor channel 32 via passageway 38. In the event that cryocooler 22 is operative in the system, vapor in channel 32 will condense and the resulting condensate liquid will flow into the circumferential grooves 34, then into the connecting passageway 38, and then into the liquid channel 36. The flow takes place as the result of capillary-induced pressure differences.

Figure 4:
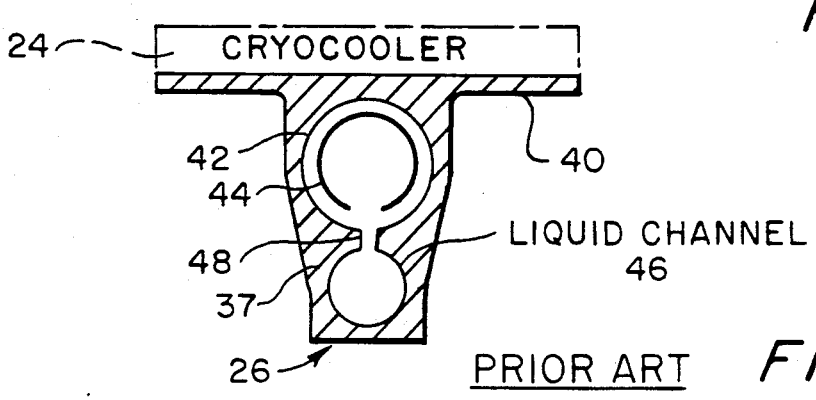
PRIOR ART FIG. 4
FIG. 4 is a cross-sectional view of a heat sink connected between the switch of FIG. and a second cryocooler.

In FIG. 4 a similar structure for heat sink 26 is illustrated. The body of this heat sink is indicated at reference numeral 37 and is of a shape similar to that of heat sink body 27 of heat sink 20 (FIG. 3). A flange 40 extends perpendicularly from the body 37 and makes thermal contact with the second cryocooler 24 so that fluid within heat sink 26 undergoes change between evaporation and condensation phases when cryocooler 24 becomes operative. As previously explained, the overall system of the present invention is intended to operate with only one cryocooler operating at a particular time. Since the useful life of presently designed cryocoolers is quite limited, by selectively switching in cryocooler 22 or 24, the useful life of the surveillance system shown in FIG. 1 is effectively doubled. Means for selectively switching in cryocooler 22 or 24 can be done by remote radial link or automatically programmed, as is evident to those skilled in the art.

The heat sink 26 includes vapor and liquid channels identical to those of heat sink 20 (FIG. 3). Thus, a vapor channel 42 having circular cross section extends along the length of the heat sink while a second channel, in the form of liquid channel 46, extends in parallel spaced relationship to the vapor channel 42, separated by passageway 48. The cross-sectional diameter of vapor channel 42 is greater than that of liquid channel 46. Circumferential grooves 44, similar to grooves 34 of heat sink 20, serve as a wick to transfer the liquid formed in channel 42 as the result of vapor condensation when cryocooler 24 is operating.

Figure 2:
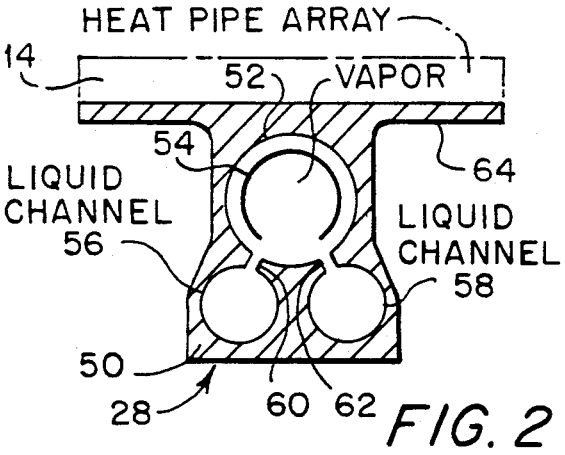
FIG. 2 is a cross-sectional view of the heat pipe thermal switch.

The contribution to the space surveillance system indicated in FIG. 1 is the heat pipe thermal switch generally indicated by reference numeral 28 and shown in FIG. 2. The thermal switch includes a central metallic body 50 which incorporates a vapor channel 52 therethrough. As in the case of the heat sinks 20 and 26 (FIGS. 3 and 4), the wall of the vapor channel contains a multitude of circumferential grooves 54 which are shown schematically, and which extend over the length of the heat input zone containing the heat pipe array 14. In order to effect a thermal switch result, two liquid channels 56 and 58 communicate with the vapor channel 52. These liquid channels are similar to the liquid channels 36 and 46 of heat sinks 20 and 26. The two liquid channels have respective passageways 60 and 62 for connecting the liquid channels to the vapor channel. Each passageway serves to draw liquid from its liquid channel and feed it to the circumferential grooves of the vapor channel, where it evaporates as it absorbs heat from the heat pipe array. Liquid channel 56 in the switch is continuous with liquid channel 36 of heat sink 20 while the second liquid channel 58 is continuous with the liquid channel 46 of heat sink 26; and the heat sink vapor channels 32, 42 are connected in parallel with vapor channel 52 of the switch.

In order to effect heat transfer between the heat pipe array 14 and the thermal switch 28, the heat pipe array is brought into thermal contact with a flange 64 of the thermal switch 28. It is important to note that grooves are formed circumferentially for wall wicking in both the evaporator and condenser sections of the vapor channel. The helical groove is a few mils wide and deep. In the evaporator section of switch 28, the wall grooves are sealed in the arcuate vapor channel portion between the two liquid channels 56 and 58 to prevent liquid in an operating channel from being drawn into the non-operating liquid channel. No grooves exist in liquid chambers. Liquid flows along those chambers due to capillary action and surface tension forces. When setting up the system of the present invention, the interconnected heat pipe array, switch, and heat sinks are charged with liquid sufficient for only one liquid channel. The one connected to the non-operating heat sink will fill with vapor and thus not function as a heat pipe. This is due to the fact that liquid tends to accumulate in the liquid channel of a heat sink connected to an operative cryocooler. The remaining heat sink connected to the non-operating cryocooler only conducts minor heat through the metallic body of the heat pipe which is of little significance.

Accordingly, by utilizing a heat pipe thermal switch incorporating a single vapor channel and two parallel connected liquid channels, a single conduit may be employed between a heat pipe array such as 14 and a selected cryocooler. In the event that a selected cryocooler becomes non-operative, the remaining cryocooler is connected to the heat pipe array 14 through the same conduit, namely the thermal switch 28, and redistribution of liquid in the switch causes thermal decoupling of the cooler which is inoperative. This permits the utilization of redundant cryocoolers for extending the lifetime of a surveillance system employing cooled detectors.

It should be understood that the invention is not limited to the exact details of construction shown and described herein for obvious modifications will occur to persons skilled in the art.

I claim:

1. A heat pipe switch comprising:

a body;

a vapor channel formed in the body;

a first liquid channel formed in the body and continuously extending in parallel spaced relation to the vapor channel;

a first passageway existing between the vapor channel and first liquid channel;

a second liquid channel formed in the body and continuously extending in parallel spaced relationship to the vapor channel;

a second passageway existing between the vapor channel and the second liquid channel;

sufficient working fluid to fill only one liquid channel connected to an operative fluid cooler.

2. The structure set forth in claim 1 wherein the length of the vapor channel has grooves formed therein for wetting the wall of the vapor channel except for that portion of the vapor channel wall located directly between the passageways to the liquid channels.

3. The structure set forth in claim 2 wherein the vapor channel has a circular cross section.

4. The structure set forth in claim 3 wherein each liquid channel has a circular cross section and has an identical diameter which is less than that of the vapor channel.

5. A heat pipe cooling system for a detector focal plane structure comprising:

a pair of cryocoolers;

first and second heat sinks connected at corresponding first ends thereof to a respective cryocooler, each heat sink having a vapor and a liquid channel formed therein; and a heat pipe thermal switch thermally connected at one end thereof to the focal plane structure for picking up heat therefrom, the switch having a body, a vapor channel formed in the body and communicating with the vapor channels in the heat sinks, a first liquid channel formed in the body and extending in parallel spaced relation to the switch vapor channel and serially communicating with the liquid channel in the first heat sink, a first passageway existing between the vapor channel and first liquid channel of the switch, a second liquid channel formed in the body and extending in parallel spaced relation to the switch vapor channel and serially communicating with the liquid channel in the second heat pipe, a second passageway existing between the switch vapor channel and the switch second liquid channel, sufficient working fluid to fill only one switch liquid channel and the liquid channel of one heat sink which is connected to an operative fluid cooler.

6. The structure set forth in claim 5 wherein the length of the vapor channels in the switch and heat sinks have grooves formed therein for wetting the wall of the vapor channels.

7. The structure set forth in claim 6 wherein each vapor and liquid channel has a circular cross section.

8. The structure set forth in claim 7 wherein each liquid channel of the switch has an identical diameter which is less than that of the switch vapor channel.

* * * * *

UNITED STATES PATENT AND TRADEMARK OFFICE

CERTIFICATE OF CORRECTION

PATENT NO. : 5,111,874

DATED : May 12, 1992

INVENTOR(S) : Robert L. Kosson

It is certified that error appears in the above-identified patent and that said Letters Patent is hereby corrected as shown below:

Column 1, line 67, after "FIG." insert --1--.

Signed and Sealed this

Twenty-ninth Day of June, 1993

*Attest:*

Michael K. Kirk

MICHAEL K. KIRK

*Attesting Officer*

*Acting Commissioner of Patents and Trademarks*